US011708650B2

(12) United States Patent
Wang

(10) Patent No.: US 11,708,650 B2
(45) Date of Patent: Jul. 25, 2023

(54) FABRIC WOVEN BY IMITATING WARP KNITTING

(71) Applicant: ADVANCE DENIM CO., LTD., Guangdong (CN)

(72) Inventor: Zongwen Wang, Guangdong (CN)

(73) Assignee: ADVANCE DENIM CO., LTD., Foshan (CN)

( * ) Notice: Subject to any disclaimer, the term of this patent is extended or adjusted under 35 U.S.C. 154(b) by 550 days.

(21) Appl. No.: 16/978,699

(22) PCT Filed: Sep. 11, 2019

(86) PCT No.: PCT/CN2019/105244
§ 371 (c)(1),
(2) Date: Sep. 6, 2020

(87) PCT Pub. No.: WO2021/046732
PCT Pub. Date: Mar. 18, 2021

(65) Prior Publication Data

US 2023/0123876 A1 Apr. 20, 2023

(51) Int. Cl.
*D03D 13/00* (2006.01)
*D03D 15/56* (2021.01)
(Continued)

(52) U.S. Cl.
CPC ..... *D03D 13/004* (2013.01); *D02G 3/328* (2013.01); *D02G 3/36* (2013.01); *D03D 15/56* (2021.01); *D10B 2401/061* (2013.01)

(58) Field of Classification Search
CPC ..... D03D 13/004; D03D 15/56; D03D 13/00; D03D 15/00; D02G 3/328; D02G 3/36; D02G 3/32; D10B 2401/061
See application file for complete search history.

(56) References Cited

U.S. PATENT DOCUMENTS 3,943,731 A * 3/1976 Niederer ..... D04B 21/14 66/204
4,520,636 A * 6/1985 Schnegg ..... D04B 21/14 66/213

(Continued)

FOREIGN PATENT DOCUMENTS

CN 102834557 A 12/2012
CN 106367873 A 2/2017
CN 108286109 A 7/2018

OTHER PUBLICATIONS

Standard GB/T5453-97 Determination of the Permeability of Fabrics to Air.

(Continued)

*Primary Examiner* — Robert H Muromoto, Jr.

(57) ABSTRACT

A fabric woven by imitating warp knitting, which includes first warps, second warps, first wefts, and second wefts; the first warps and the first wefts are interlaced to form the face of the fabric, and the second warps and the second wefts are interlaced to form the back of the fabric; and 7 to 15 weft interlacing points are arranged between each two adjacent groups of warp interlacing points on the second warps. The fabric woven by imitating warp knitting in the present invention has not only the appearance style of woven fabrics but also the characteristics of good air permeability and good hand feel of warp-knitted fabrics.

10 Claims, 3 Drawing Sheets

(51) Int. Cl.

| | |
|---|---|
| ***D02G 3/32*** | (2006.01) |
| ***D02G 3/36*** | (2006.01) |
| *D03D 1/00* | (2006.01) |

(56) References Cited

U.S. PATENT DOCUMENTS

| | | | | |
|---|---|---|---|---|
| 4,984,181 | A * | 1/1991 | Kliman | D04B 37/00 345/589 |
| 8,308,519 | B2 * | 11/2012 | Stange | H01J 5/34 445/27 |
| 2018/0105962 | A1 * | 4/2018 | Yu | D04B 21/14 |
| 2019/0284730 | A1 * | 9/2019 | Wang | D02G 3/38 |
| 2021/0381165 | A1 * | 12/2021 | Martikainen | D21F 1/0045 |
| 2022/0178053 | A1 * | 6/2022 | Wang | D03D 15/292 |

OTHER PUBLICATIONS

Standard FZ/T 01034-2008 Textiles—Test Method of the Tensile Elasticity for Woven Fabrics.

Standard GB/T 13772.2-2018 Textiles—Determination of the Slippage Resistance of Yarns at a Seam in Woven Fabrics—Part 2: Fixed Load Method.

* cited by examiner

FABRIC WOVEN BY IMITATING WARP KNITTING

TECHNICAL FIELD

The present invention relates to the field of textiles, and mainly relates to a fabric woven by imitating warp knitting.

BACKGROUND ART

With the development of social economy and the improvement of the living standard of people, the requirement of people on clothing is higher and higher, more and more people also put forward higher pursuit for the comfort of clothing while pursuing the casualness, figure flattering, styles and so on of clothing, so consumers not only hope that the appearance of fabrics has the style of traditional jeans, but also require that fabrics are soft, light, thin, comfortable and air-permeable and have excellent elastic property.

The main advantages of woven fabrics are stable structure, diversified styles and appearances, smooth fabric surface, almost no sagging phenomenon during hanging and suitability for various tailoring methods, but the air permeability, hand feel and other properties of woven fabrics are not as good as those of knitted fabrics.

With the rapid development of knitting technology, the loop structure of knitted fabrics makes these excellent wearabilities possible, so weft-knitted jean fabrics appear in the market. However, although the weft-knitted jean fabric has good stretchability weft-wise, the weft-knitted jean fabric cannot meet the requirement for the dimensional stability of clothing, failing to meet the requirement of the market.

Warp-knitted fabrics have a structure and style which are different from those of weft-knitted fabrics. Warp-knitted fabrics have the advantages of low raveling property, firmness and good dimensional stability, and by adjusting yarn materials, textures and post-finishing, effects with visual impact can be produced. However, the warping and weaving of warp knitting have high requirement for the tensile strength of yarns, and chemical fibers are often adopted in production, while yarns which are spun from staple fibers (such as cotton fibers) are seldom adopted. As the strength of yarns spun from staple fibers is not as good as that of chemical fabrics (such as Dacron and chinlon), the mechanical property of cotton yarns may be easily damaged due to the fluctuation of tension in the warping and weaving processes of warp knitting; and moreover, as hairness, neps and so on exist on yarns spun from staple fibers, entangled and gathered hairness or neps may block raddles and guide needles to cause yarn breakage in the warping or weaving process of warp knitting. Therefore, besides a requirement for the strength of yarns spun from staple fibers in the process of warp knitting, there is a higher requirement for the hairness of the yarns, coarse count yarns can more hardly meet this requirement, and as a result, the appearance style of warp-knitted fabrics is limited.

To sum up, conventional woven fabrics and knitted fabrics have respective advantages and disadvantages, that is, traditional woven fabrics do not have the characteristics of air permeability, hand feel and other properties of warp-knitted fabrics, while the appearance style of warp-knitted fabrics is not as diversified as that of woven fabrics. A fabric which has not only the style of woven fabrics but also the characteristics of warp-knitted fabric does not exist in the market, so the prior art needs to be improved.

SUMMARY OF THE INVENTION

In view of the aforementioned defects of the prior art, the present invention is directed to provide a fabric woven by imitating warp knitting. By improving the texture of the fabric, the fabric has not only the appearance style of woven fabrics but also the characteristics of good air permeability and good hand feel of warp-knitted fabrics, and is intended to solve the problems of poor air permeability and hand feel existing in conventional woven fabrics.

The technical solution of the present invention is as follows:

The fabric woven by imitating warp knitting comprises first warps, second warps, first wefts, and second wefts; the first warps and the first wefts are interlaced to form the face of the fabric, and the second warps and the second wefts are interlaced to form the back of the fabric; 7 to 15 weft interlacing points are arranged between each two adjacent groups of warp interlacing points on the second warps, and there is at least 1 warp interlacing point in each group of warp interlacing points.

In the fabric woven by imitating warp knitting, 7 to 11 weft interlacing points are arranged between each two adjacent groups of warp interlacing points on the second warps.

In the fabric woven by imitating warp knitting, 1 to 2 warp interlacing points are arranged in each group of warp interlacing points.

In the fabric woven by imitating warp knitting, stretch yarns are adopted as the first warps, non-stretch yarns or small-stretch yarns are adopted as the second warps, and the shrinkage rate of the first warps is higher than that of the second warps.

In the fabric woven by imitating warp knitting, stretch yarns are adopted as the first wefts and the second wefts.

In the fabric woven by imitating warp knitting, the proportion of the first warps and the second warps is 2:1 to 1:3, and the count of the first warps is coarser than the count of the second warps.

In the fabric woven by imitating warp knitting, the second warps and the second wefts adopt 8-shaft 3-progression sateen weave.

In the fabric woven by imitating warp knitting, the first warps and the first wefts adopt 3/1 right-hand twill weave.

In the fabric woven by imitating warp knitting, the first warps and the second warps are yarns made of staple fibers, yarns made of filaments, core-spun stretch yarns made by adopting staple fibers to cover elastic filaments or core-spun stretch yarns made by adopting filaments to cover elastic filaments;

if the first warps or the second warps are the yarns made of the staple fibers, the count range is between 6S and 60S;

if the first warps or the second warps are the yarns made of the filaments, the count range is between 40D and 600D;

if the first warps or the second warps are the core-spun stretch yarns made by adopting staple fibers to cover elastic filaments, the overall count range is between 6S and 60S, and the range of the elastic filaments is between 20D and 300D;

if the first warps or the second warps are the core-spun stretch yarns made by adopting staple fibers to cover elastic filaments, the overall count range is between 40D and 600D, and the range of the elastic filaments is between 20D and 300D; and the yarns adopted by the second warps may be the same as or different from the yarns adopted by the first warps.

In the fabric woven by imitating warp knitting, the first wefts and the second wefts are yarns made of staple fibers, yarns made of filaments, core-spun stretch yarns made by adopting staple fibers to cover elastic filaments or core-spun stretch yarns made by adopting filaments to cover elastic filaments;

if the first wefts or the second wefts are the yarns made of the staple fibers, the count range is between 6S and 60S;

if the first wefts or the second wefts are the yarns made of the filaments, the count range is between 40D and 600D;

if the first wefts or the second wefts are the core-spun stretch yarns made by adopting staple fibers to cover elastic filaments, the count range is between 6S and 60S;

if the first wefts or the second wefts are the core-spun stretch yarns made by adopting staple fibers to cover elastic filaments, the overall count range is between 6S and 60S, and the range of the elastic filaments is between 20D and 300D;

if the first wefts or the second wefts are the core-spun stretch yarns made by adopting filaments to cover elastic filaments, the overall count range is between 40D and 600D, and the range of the elastic filaments is between 20D and 300D; and the yarns adopted by the second wefts may be the same as or different from the yarns adopted by the first wefts.

Beneficial effects: By optimizing the texture of the fabric woven by imitating warp knitting in the present invention, not only can the quality and strength of the fabric with a double-layered texture be ensured, but also the fabric can have good bulkiness. The face of the fabric woven by imitating warp knitting is bulky and light, and has good hand feel, and the fabric woven by imitating warp knitting is highly comfortable to wear.

DETAILED DESCRIPTION OF THE INVENTION

Figure 1:
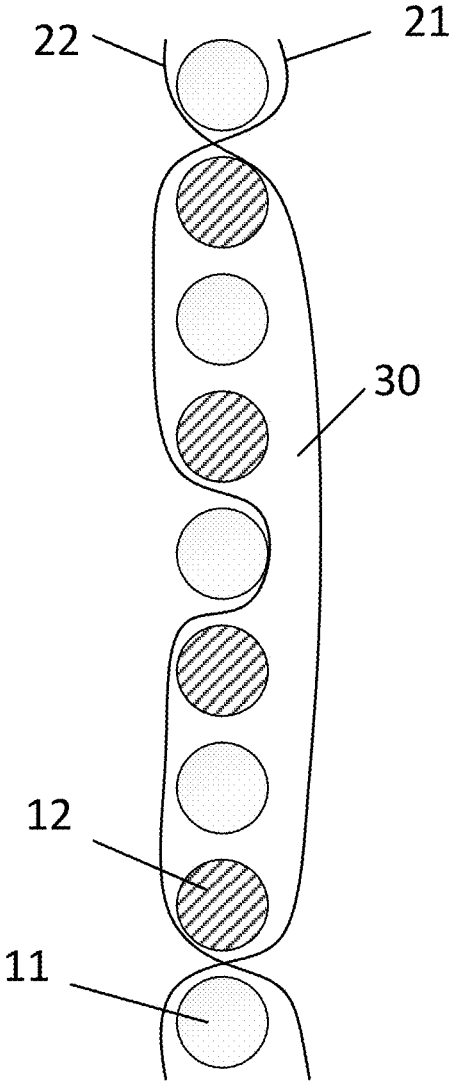
FIG. 1 is a schematic fabric texture diagram of a fabric woven by imitating warp knitting in the present invention.

The present invention provides a fabric woven by imitating warp knitting. In order to make the objective, technical solution and effects of the present invention clearer, the present invention is further described in detail hereinafter. It should be understood that the specific embodiments described herein are only intended to explain the present invention rather than to limit the present invention.

In the description of the present invention, it should be understood that directions or positional relations indicated by terms such as "center", "longitudinal", "latitudinal", "length", "width", "thickness", "upper", "lower", "front", "rear", "left", "right", "vertical", "horizontal", "top", "bottom", "inner", "outer", "clockwise" and "counterclockwise" are directions or positional relations shown by the drawings and are only intended to facilitate and simplify the description of the present invention rather than to indicate or imply that the specified devices or elements must have specific directions and be structured or operated according to the specified directions, and therefore cannot be construed as a limitation on the present invention. In addition, terms "first" and "second" are only intended for description, but cannot be construed as indicating or implying relative importance or implicitly indicating the number of the specified technical features. Therefore, features defined by "first" and "second" may explicitly or implicitly include one or more of the features. In the description of the present invention, "a plurality of" means two or more, unless otherwise explicitly defined.

In the description of the present invention, it should be noted that unless otherwise explicitly specified and defined, the understanding of terms "installed", "linked" and "connected" should be generalized, for example, the terms may be fixed connected, detachably connected or integrally connected; the terms may be mechanically connected, electrically connected or communicating with each other; and the terms may be directly linked, indirectly linked through an intermediate, communication between the interiors of two elements or an interactive relation between two elements. For those of ordinary skill in the art, the specific meanings of the aforementioned terms in the present invention may be understood according to specific circumstances.

In the present invention, unless otherwise explicitly specified or defined, the first feature being "on" or "beneath" the second feature may include the first feature being in direct contact with the second feature or the first feature being in contact with the second feature through another feature rather than in direct contact with the second feature. Moreover, the first feature being "on", "over" and "above" the second feature may include the first feature being over and above the second feature, or only represents that the level of the first feature is higher than the level of the second feature. The first feature being "beneath", "under" and "below" the second feature may include the first feature being under and below the second feature, or only represents that the level of the first feature is lower than the level of the second feature.

The disclosure hereinafter provides a lot of different embodiments or examples to implement the different structures of the present invention. In order to simplify the disclosure of the present invention, the parts and configurations of the specific examples are described hereinafter. Certainly, they are only illustrative rather than intended to limit the present invention. In addition, the present invention may repeat reference numbers or reference letters in the different examples, and such repetition is intended for simplification and clarification rather than indicates the relation between the various embodiments and/or configurations discussed. In addition, although the present invention provides the examples of various specific processes and materials, those of ordinary skill in the art can realize the application of other processes and/or the use of other materials.

The present invention provides a fabric woven by imitating warp knitting, which comprises warps and wefts, the warps and the wefts are interlaced in an alternate floating and sinking manner to form the fabric, and the compact structure which is formed by interlacing the warps and the wefts according to a specific texture enables the fabric to have the appearance style of woven fabrics as well as the characteristics of good air permeability and good hand feel of warp-knitted fabrics. The fabric comprises a face and a back, the face of the fabric has the style of woven fabrics, and the back of the fabric, i.e. the side close to skin, has the air permeability and hand feel of warp-knitted fabrics, enabling the back of the fabric to have good skin-friendly comfort.

Specifically, the fabric woven by imitating warp knitting comprises first warps, second warps, first wefts, and second wefts; the first warps and the first wefts are interlaced to form the face of the fabric, and the second warps and the second wefts are interlaced to form the back of the fabric; and on the back of the fabric, 7 to 15 weft interlacing points may be arranged between each two adjacent groups of warp interlacing points on the second warps, and there is at least 1 warp interlacing point in each group of warp interlacing points. It should be noted that the first warps and the second warps are only intended to facilitate description rather than represent the number of warps and wefts, and only facilitate the description of the fabric.

The first warps (21) and the first weft (11) are interlaced to form the face of the fabric, and the face of the fabric may be designed according to different styles, such as 3/1 twill, having a classical jean style. The second warps (22) and the second wefts (12) are interlaced to form the back of the fabric, and by continuously arranging a plurality of weft interlacing points on the back, the compactness of the fabric is low after the second warps (22) and the second wefts (12) are interlaced, which enables the fabric to be easily compressed when being compressed, and can help increase the air permeability, hand feel and bulkiness of the fabric. Moreover, because the second warps (22) are continuously sunken under the second wefts (12), each second warp (22) sunken under the wefts (general name for the first wefts (11) and the second wefts (12)) forms a big loop with a certain radian, as shown in FIG. 1. As a plurality of loops with a certain radian which are formed by the second warps (22) exist on the back of the fabric, many spaces (30) for storing air exist between the second warps (22) and the weft, and consequently, the back of the fabric feels soft, and is good in air permeability and bulkiness. Therefore, when in contact with skin, the back of the fabric of the present invention is quite comfortable.

As the finished fabric will undergo desizing, soda boiling, loose wash and other treatments when undergoing post-finishing, if there are too many weft interlacing points, the uninterlaced yarn fibers of the warps and the wefts cannot tightly cohere to one another, the surface hairness of the yarns will be increased, the strength of the yarns will be damaged to a certain degree, and meanwhile, the yarns will be snarled. As the back of the fabric is in contact with skin and rubs the skin during daily wearing, the yarns will be more severely snarled or entangled together crosswise, severely affecting the style and hand feel of the fabric. If the weft interlacing points are not enough, the warps and the wefts are compactly interlaced on the back of the fabric, the fabric cannot be easily stretched, consequently, certain parts of the human body will be heavily stressed during wearing, feeling squeezed, and as a result, the fabric will lead to a comfortable feeling when being worn. Therefore, in the present invention, 7 to 11 weft interlacing points may be arranged between each two adjacent groups of warp interlacing points on the second warps, consequently, the entangling of the yarns will not occur, and the interlacing compactness of the fabric is moderate within the range. Most preferably, the back of the fabric adopts 8-shaft 3-progression sateen weave, and it is discovered from the results of multiple trial weavings that the effect of the back of the fabric adopting the 8-shaft 3-progression sateen weave is best.

Furthermore, if there are too many weft interlacing points, due to the great shrinkage difference between the upper layer and the lower layer, the fabric surface will be wrinkled, and the lines will become vague. It is discovered in a lot of experiments and trial weavings that the lines of the fabric surface within a range from 7 to 11 floats look better and that warp-wise shrinkage is not too great. Moreover, in the fabric adopting the range, the second warps form loops with a certain radian, the radian is moderate, the loops are upright, and therefore, the fabric is good in air permeability and hand feel and best in bulkiness.

Preferably, there are 1 to 2 warp interlacing points in each group of warp interlacing points. Because this can make the spacing between the adjacent loops with a certain radian small, the loops with a certain radian can be distributed on the back of the fabric to the max, so that the fabric feels soft and smooth.

The first warps and the second warps may be the same type of yarns or different yarns, the same type of yarns or different yarns may be adopted as the first wefts and the second wefts, stretch yarns or non-stretch yarns are adopted as the first warps, stretch yarns or non-stretch yarns are adopted as the first wefts, stretch yarns or non-stretch yarns are adopted as the second warps, and stretch yarns or non-stretch yarns are adopted as the second wefts. Wherein, the non-stretch yarns may be all the yarns without elasticity in the prior art, such as cotton yarns, tencel, modal, wool yarns, tencel-cotton blended yarns and cotton-modal blended yarns. The stretch yarns may be all the yarns with elasticity in the prior art, such as single core-spun yarns and dual core-spun yarns, and more specifically, may be cotton yarn-covered spandex, cotton yarn-covered dacron-covered spandex, cotton yarn-covered chemical elastic filaments, etc.

Further, stretch yarns may be adopted as the first wefts and the second wefts, and thus, the fabric woven by imitating warp knitting has elasticity weftwise, and can be easily stretched weftwise. The combination of the weft-wise elasticity and the warp-wise loops with a certain radian reduces both warp-wise and weft-wise stresses when the fabric is worn by the human body, so the fabric is more comfortable to wear.

Further, stretch yarns may be adopted as the first warps, non-stretch yarns or small-stretch yarns may be adopted as the second warps, and the shrinkage rate of the first warps is 5% or above higher than the shrinkage rate of the second warps. As stretch yarns are adopted as the first warps and non-stretch yarns or small-stretch yarns are adopted as the second warps, after the fabric undergoes conventional post-finishing, the first warps and the first wefts that are interlaced will be more shrunk than the second warps and the second wefts, so that the plurality of loops with a certain radian on the back of the fabric will be more compactly arranged and the radian of the loops with a certain radian will be increased, consequently, more spaces capable of storing air will be formed on the back of the fabric, and the fabric surface will become bulkier, lighter and more air-permeable and feel better. Compared with woven fabrics with the same thickness, the fabric woven by imitating warp knitting in the present invention is lighter in weight and feels bulkier.

For clothing worn by a person, the most important thing is that the human body feels comfortable during wearing. When the human body exercises, the clothing can bring a certain stressed feeling to certain parts (such as buttocks and knees), thus making the person feel tight and stressed during wearing, failing to achieve a comfortable effect. In order to solve the problem, stretch yarns can be adopted as both warps and wefts to make a four-way stretch fabric, so that the fabric can be more easily stretched warpwise and weftwise, reducing the stress of the human body caused by the clothing. The easy stretching of the fabric is an important characteristic that can make consumers feel the comfort of clothing. When elastic warps and elastic wefts are adopted to be interlaced to form a single-layered four-way stretch fabric, the fabric made will be shrunk, the surface of the shrunk fabric will become uneven and can be easily wrinkled, severely affecting the appearance and hand feel of the fabric, moreover, the warp-wise shrinkage rate is high, and as a result, the stretch fabric will be curled during tailoring, severely affecting the efficiency of production. For a conventional double-layered stretch fabric, in order to enable the fabric to have 360-degree elastic property, warps with or without elasticity and elastic wefts can be adopted to be interlaced to form the upper layer of the fabric, warps with or without elasticity and elastic wefts can be adopted to be interlaced to form the lower layer of the fabric, and thereby the double-layered fabric has a four-way stretch effect. However, after being treated warpwise and weftwise, the conventional double-layered stretch fabric will be shrunk, so that the fabric becomes compact warpwise and weftwise, and although the elastic property of the fabric is excellent, the fabric is highly compact. As the human body squats, stands up or exercises during wearing, the double-layered stretch fabric can bring a stressed feeling to certain parts (such as buttocks and knees), making the person feel uncomfortable, failing to meet the requirement for the comfort of clothing.

The fabric woven by imitating warp knitting in the present invention can be adopted to solve the problem of discomfort caused by the stressed feeling. When stretch yarns are adopted as the first warps and non-stretch yarns or small-stretch yarns are adopted as the second warps, the fabric woven by imitating warp knitting also has four-way stretch property. As the shrinkage of the fabric made of the stretch yarns is higher than that of the fabric made of the non-stretch yarns, the face of the fabric woven from the stretch yarns can be shrunk, consequently, the warps and wefts of the face of the fabric are more compactly interlaced, and the face of the fabric presents the style of woven fabrics, meeting the pursuit of people for the style of woven fabrics. As the special texture provided by the present invention is adopted, the second warps and the second wefts are not compactly interlaced, the back of the fabric has the characteristic of low compactness of weft-knitted fabrics, so that the back of the fabric feels soft. Because the loops with a certain radian are parallel relative to skin, as the fabric and skin rub each other up and down, all the loops with a certain radian move along the moving direction of the skin, and therefore, the discomfort of the skin caused by the fabric can be greatly decreased. More preferably, when stretch yarns are adopted as the first warps and non-stretch yarns are adopted as the second warps, stretch yarns are also adopted as the first wefts and the second wefts, and thus, the fabric woven by imitating warp knitting has better elasticity, can be more easily stretched, and feels soft.

The density and counts of warps and wefts can determine the surface density of a fabric; the coarser the counts are, the higher the density is and the larger the coverage of the fabric is; and the lower the compactness of the fabric is, and the higher the bulkiness of the fabric is. The first warps and the first wefts compose the face of the fabric, and the second warps and the second wefts compose the back of the fabric; and when the proportion of the first warps and the second warps is 2:1 to 1:3, the count of the first warps is preferably coarser than that of the second warps, and thus, the coverage of the first warps on the face of the fabric is large while the coverage of the second warps on the back of the fabric is small, which is good for the bulkiness of the fabric. Furthermore, the coarser the average count of the back of the fabric is than the average count of the face, the greater the influence on the appearance of the face of the fabric is, making the lines of the face of the fabric vague, and hence, the count of the first warps is preferably coarser than that of the second warps to ensure that the lines of the face of the fabric are clear.

Both the first warps and the second warps may be yarns made of staple fibers or filaments, and the materials and counts of the first warps and the second warps may be set to be the same or different according to requirement. Taking the first warps as an example for description, staple fibers may be cotton fibers, bast fibers, tencel, modal, viscose, rayon, dacron, chinlon, etc., preferably cotton fibers, and the count range of the first warps may be between 6S and 60S, including the two end values, i.e. 6S and 60S. If the first warps are the yarns made of the filaments, the count range may be between 40D and 600D. If the first warps are elastic, the yarns may be core-spun stretch yarns (such as staple fiber-covered spandex yarns) made by adopting staple fibers to cover elastic filaments or core-spun stretch yarns made by adopting filaments to cover elastic filaments. If the first warps are the core-spun stretch yarns made by adopting staple fibers to cover elastic filaments, the overall count range is between 6S and 60S, wherein the range of the elastic filaments is between 20D and 300D. If the first warps or the second warps are the core-spun stretch yarns made by adopting staple fibers to cover elastic filaments, the overall count range is between 40D and 600D, and the range of the elastic filaments is between 20D and 300D. The first warps may be single core-spun yarns or dual core-spun yarns, such as cotton yarn-covered lycra, cotton yarn-covered dacron-covered lycra, cotton yarn-covered chemical elastic filament-covered lycra and cotton yarn-covered chemical elastic filaments. The optional range of the second warps is the same as that of the first warps.

Both the first wefts and the second wefts may be yarns made of staple fibers or filaments, and the materials and counts of the first wefts and the second wefts may be set to be the same or different according to requirement. Taking the first wefts as an example for description, if the first wefts are the yarns made of the staple fibers, the count range may be between 6S and 60S. If the first wefts are the yarns made of the filaments, the count range may be between 40D and 600D. If the first wefts are elastic, the yarns may be core-spun stretch yarns (such as staple fiber-covered spandex yarns) made by adopting staple fibers to cover elastic filaments or core-spun stretch yarns made by adopting filaments to cover elastic filaments. If the first wefts are the core-spun stretch yarns made by adopting staple fibers to cover elastic filaments, the overall count range is between 6S and 60S, wherein the range of the elastic filaments is between 20D and 300D. If the first wefts or the second wefts are the core-spun stretch yarns made by adopting filaments to cover elastic filaments, the overall count range is between 40D and 600D, and the range of the elastic filaments is between 20D and 300D. The first wefts may be single core-spun yarns or dual core-spun yarns, such as cotton yarn-covered spandex, cotton yarn-covered dacron-covered spandex and cotton yarn-covered chemical elastic filaments. The optional range of the second wefts is the same as that of the first wefts.

The adopted fabric woven by imitating warp knitting provided by the present invention at least has the following advantages:

1. The fabric has not only the appearance style of woven fabrics but also the characteristics of good air permeability and good hand feel of warp-knitted fabrics.

2. The surface of the fabric is bulky and light. In the fabric woven by imitating warp knitting, the first warps and the first wefts are interlaced to form the face of the fabric, the second warps and the second wefts are interlaced to form the back of the fabric, the plurality of loops with a certain radian which are formed on the back of the fabric form many spaces for storing air, and therefore, compared with fabrics with the same thickness, the fabric woven by imitating warp knitting is lighter in weight and feels bulkier. Preferably, stretch yarns are adopted as the first warps, and non-stretch yarns are adopted as the second warps; and after the fabric undergoes conventional post-finishing, the first warps and the first wefts that are interlaced will be more shrunk than the second warps and the second wefts that are interlaced, so that the plurality of loops with a certain radian on the back of the fabric will be more compactly arranged and the radian of the loops with a certain radian will be increased, and consequently, the air permeability and hand feel of the fabric will become better.

3. The fabric woven by imitating warp knitting is double-sided. As the first warps and the second warps are respectively interlaced to form a double-layered structure, the colors of the warps of the face and the back may be the same or different, the expressiveness in fashion is higher, and designers are given with a larger room to develop; and moreover, multiple wearing effects can be achieved by one article of clothing for consumers.

4. The fabric surface feels good. The present invention is a special texture, the loops with a certain radian on the back of the fabric are upright loops, and as the fabric and skin rub each other up and down, all the loops with a certain radian move along the moving direction of the skin, and therefore, the discomfort of the skin caused by the fabric can be greatly decreased.

5. The efficiency of weaving is high. Although the two types of wefts are adopted in the present invention, in the process of weaving, two systems of wefts can be adopted for weaving, or one system of wefts can be adopted for weaving. In the present invention, one system of wefts are preferably adopted. Because the warp density is higher than the weft density in the present invention and the weft density setting is not very different from that of a single-layered fabric during weaving, the efficiency of weaving is high, and consumed time is short.

Through specific embodiments, the present invention is further described hereinafter.

Embodiment 1

Figure 2:
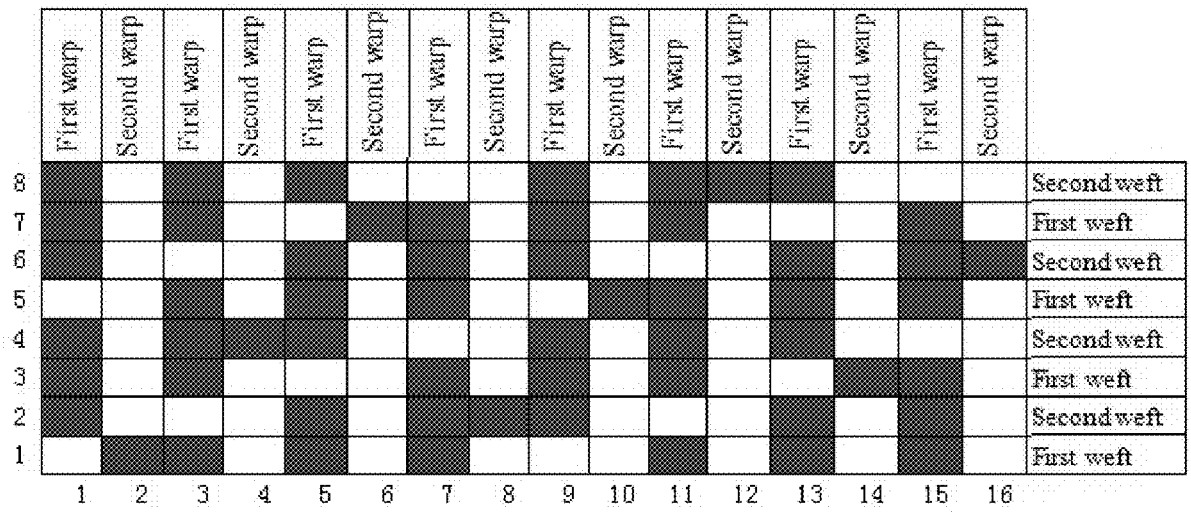
FIG. 2 is a texture diagram of a fabric woven by imitating warp knitting in embodiment 1 of the present invention.

The texture of the fabric woven by imitating warp knitting in the present embodiment is shown as FIG. 2, colored checks represent warp interlacing points, blank checks represent weft interlacing points, the face of the fabric adopts 3/1 right-hand twill weave, and the back of the fabric adopts 8-shaft 3-progression sateen weave.

First warp: Core-spun yarns made by adopting pure cotton (count: 12S) to cover spandex (denier: 40D; stretching ratio: 2.0) are adopted; and the color of the yarns is indigo;

Second warp: Yarns made by pure cotton (count: 40S) combing and ring spinning are adopted;

First weft: Dual core-spun yarns made by adopting pure cotton (count: 21S) to cover T400 (denier: 75D) and then covering spandex (denier: 40D; stretching ratio: 3.0) are adopted;

Second weft: Dual core-spun yarns made by adopting pure cotton (count: 21S) to cover T400 (denier: 75D) and then covering spandex (denier: 40D; stretching ratio: 3.0) are adopted;

Reed count for warp looming: 56 strips (4 warps in each reed gap); Density of wefts for weaving: 52T; Coverage of first warps: 56/28 (11.8)=58.3%; and Coverage of second warps: 56/28 (40)=31.6%.

After the woven fabric woven by imitating warp knitting in the present embodiment was treated by the conventional post-finishing process, the property data of the fabric were tested, and the test result is shown as table 1. Wherein, the air permeability of the fabric woven by imitating warp knitting in the present embodiment can reach 46.32 mm/s, so the air permeability is good; and the bulkiness can reach 356.45 $cm^3/g$, so the bulkiness is good. It can be seen from the data of table 1 that the fabric woven by imitating warp knitting in the present embodiment is good in elasticity and slippage resistance. The appearance of the fabric woven by imitating warp knitting in the present embodiment has the appearance style of woven fabrics, for example, the twill lines are clear and three-dimensional, and the warps and the wefts are tightly interlaced. Due to the design of the texture, the fabric feels soft and comfortable, and when in contact with skin, the fabric can bring a skin-friendly touch feeling, and is comfortable, soft and natural.

The test of related properties in the present invention is based on the following:

According to the standard GB/T5453-97 *Determination of the Permeability of Fabrics to Air*, a YG461E air permeability tester is adopted to test the air permeability of the fabric.

In terms of bulkiness, a FAST-1 compressible fabric style tester is adopted to respectively test fabric thickness T2 under 2 $cN/cm^2$ and fabric thickness $T_{100}$ under 100 $cN/cm^2$, the fabric apparent thickness calculation formula is $T_0=T_2-T_{100}$, and the fabric bulkiness calculation formula is $$B = \frac{T_0}{W} \times 10^3;$$

in the formula, B is bulkiness ($cm^3/g$), $T_0$ is apparent thickness (mm), and W is fabric surface density ($g/m^2$).

According to the standard FZ/T 01034-2008 *Textiles—Test Method of the Tensile Elasticity for Woven Fabrics*, the tensile elasticity property of the woven fabric is tested, such as elastic elongation, elastic recovery and extension rate (i.e. plastic deformation).

According to the state standard GB/T 13772.2-2018 *Textiles—Determination of the Slippage Resistance of Yarns at a Seam in Woven Fabrics—Part 2: Fixed Load Method*, the yarn slippage (i.e. slippage) resistance of the woven fabric at warp-wise and weft-wise seams is tested.

TABLE 1

| | Recovery rate | Elongation | Extension rate | Slippage |
|---|---|---|---|---|
| Warp-wise | 76.6% | 24.4% | 4.6% | 0.32 |
| Weft-wise | 91.8% | 60.4% | 3.5% | 0.43 |

Embodiment 2

Figure 3:
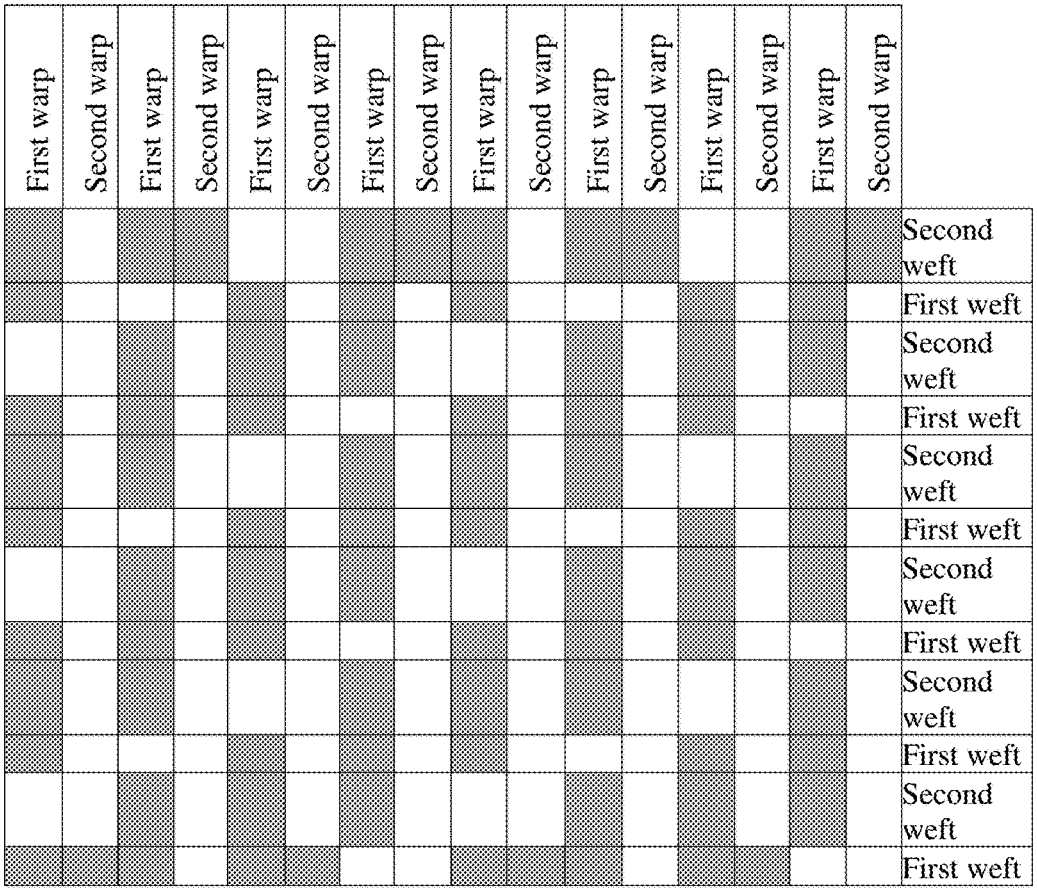
FIG. 3 is a texture diagram of a fabric woven by imitating warp knitting in embodiment 2 of the present invention.

The texture of the fabric woven by imitating warp knitting in the present embodiment is shown as FIG. 3, colored checks represent warp interlacing points, blank checks represent weft interlacing points, the face of the fabric adopts 3/1 right-hand twill weave, and the back of the fabric is a 12-weft face texture.

First warp: Yarns made of pure cotton (count: 10S) are adopted, and the color of the yarns is indigo;

Second warp: Yarns made by pure cotton (count: 50S) combing are adopted, and the color of the yarns is white;

First weft: Dual core-spun yarns made by adopting pure cotton (count: 16S) to cover dacron (denier: 75D) and then covering spandex (denier: 40D) are adopted;

Second weft: Dual core-spun yarns made by adopting pure cotton (count: 16S) to cover dacron (denier: 75D) and then covering spandex (denier: 40D) are adopted;

Reed count for warp looming: 60 strips (4 warps in each reed gap);

Density of wefts for weaving: 46T;

Coverage of first warps: 60/28 (10)=67.8%; and

Coverage of second warps: 60/28 (50)=30.3%.

After the woven fabric woven by imitating warp knitting in the present embodiment was treated by the conventional post-finishing process, the property data of the fabric were tested, and the test result is shown as table 2. Wherein, the air permeability of the fabric woven by imitating warp knitting in the present embodiment can reach 58.83 mm/s, so the air permeability is good; and the bulkiness can reach 324.82 $cm^3/g$, so the bulkiness is good. It can be seen from the data of table 2 that the fabric woven by imitating warp knitting in the present embodiment is good in elasticity and slippage resistance. The appearance of the fabric woven by imitating warp knitting in the present embodiment has the appearance style of woven fabrics, for example, the twill lines are clear and three-dimensional, and the warps and the wefts are tightly interlaced. Due to the design of the texture, the fabric feels soft and comfortable, and when in contact with skin, the fabric can bring a skin-friendly touch feeling, and is comfortable, soft and natural.

TABLE 2

| | Recovery rate | Elongation | Extension rate | Slippage |
|---|---|---|---|---|
| Warp-wise | 38.2% | 13.2% | 6.2% | 0.32 |
| Weft-wise | 92.1% | 58.6% | 3.8% | 0.48 |

Embodiment 3

Figure 4:
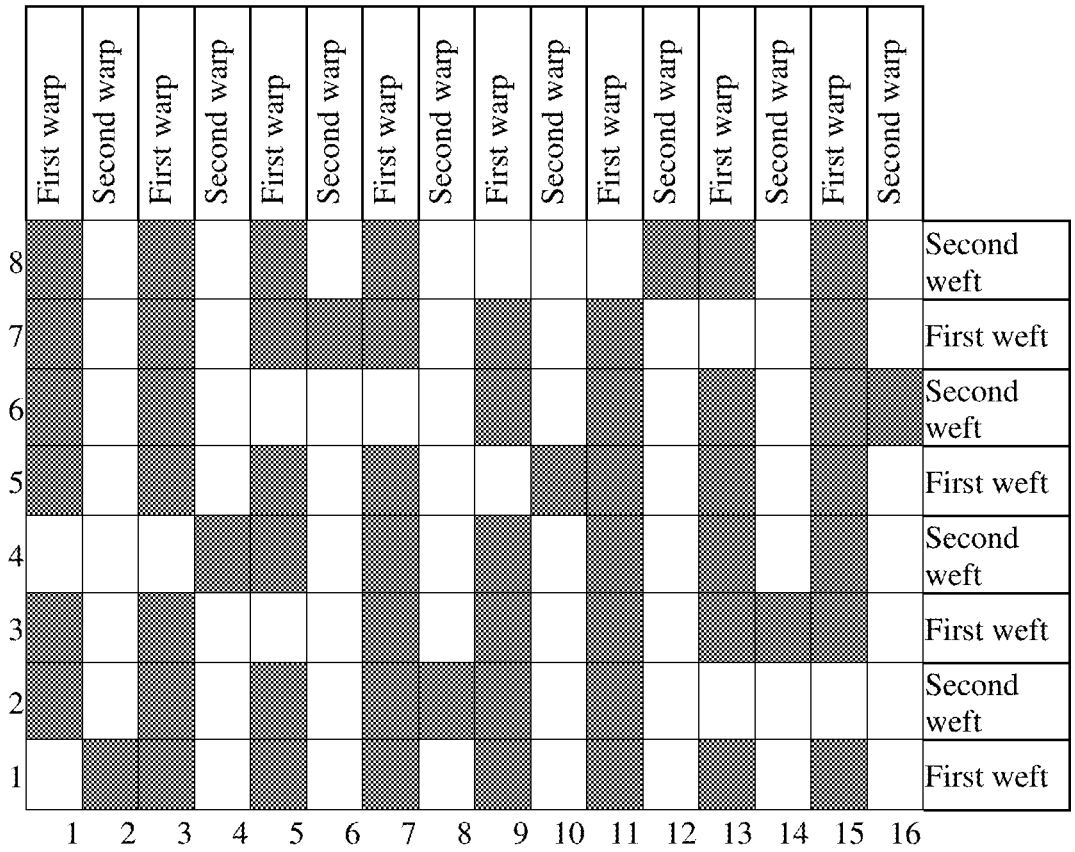
FIG. 4 is a texture diagram of a fabric woven by imitating warp knitting in embodiment 3 of the present invention.

The texture of the fabric woven by imitating warp knitting in the present embodiment is shown as FIG. 4, colored checks represent warp interlacing points, blank checks represent weft interlacing points, the face of the fabric adopts 8 pieces of composite twill plain weave, and the back of the fabric adopts 8 pieces of weft composite twill.

First warp: Core-spun yarns made by adopting pure cotton (count: 21S) to cover spandex (denier: 40D) are adopted; and the color of the yarns is indigo;

Second warp: Yarns made by pure cotton (count: 50S) combing are adopted;

First weft: Core-spun yarns made by adopting viscose-dacron blended yarns (count: 40S) to cover spandex (denier: 70D) are adopted;

Second weft: Core-spun yarns made by adopting pure cotton (count: 16S) are adopted;

Reed count for warp looming: 70 strips (4 warps in each reed gap);

Density of wefts for weaving: 72T;

Coverage of first warps: 70/28 (20.8)=54.8%; and

Coverage of second warps: 70/28 (50)=35.3%.

After the woven fabric woven by imitating warp knitting in the present embodiment was treated by the conventional post-finishing process, the property data of the fabric were tested, and the test result is shown as table 3. Wherein, the air permeability of the fabric woven by imitating warp knitting in the present embodiment can reach 40.52 mm/s, so the air permeability is good; and the bulkiness can reach 372.63 $cm^3/g$, so the bulkiness is good. It can be seen from the data of table 3 that the fabric woven by imitating warp knitting in the present embodiment is good in elasticity and slippage resistance. The appearance of the fabric woven by imitating warp knitting in the present embodiment has the appearance style of woven fabrics, for example, the twill lines are clear and three-dimensional, and the warps and the wefts are tightly interlaced. Due to the design of the texture, the fabric feels soft and comfortable, and when in contact with skin, the fabric can bring a skin-friendly touch feeling, and is comfortable, soft and natural.

TABLE 3

| | Recovery rate | Elongation | Extension rate | Slippage |
|---|---|---|---|---|
| Warp-wise | 75.3% | 24.4% | 2.1% | 0.21 |
| Weft-wise | 88.2% | 35% | 3.6% | 0.36 |

It should be understood that the application of the present invention is not limited to the aforementioned examples. For those of ordinary skill in the art, improvements or variations can be made according to the aforementioned description, and all these improvements and variations shall fall within the protection scope of the appended claims of the present invention.

The invention claimed is:

1. A fabric woven by imitating warp knitting, comprising first warps, second warps, first wefts, and second wefts; the first warps and the first wefts are interlaced to form the face of the fabric, and the second warps and the second wefts are interlaced to form the back of the fabric; and 7 to 15 weft interlacing points are arranged between each two adjacent groups of warp interlacing points on the second warps, and there is at least 1 warp interlacing point in each group of warp interlacing points.

2. The fabric woven by imitating warp knitting according to claim 1, wherein 7 to 11 weft interlacing points are arranged between each two adjacent groups of warp interlacing points on the second warps.

3. The fabric woven by imitating warp knitting according to claim 1, wherein 1 to 2 warp interlacing points are arranged in each group of warp interlacing points.

4. The fabric woven by imitating warp knitting according to claim 1, wherein stretch yarns are adopted as the first warps, non-stretch yarns or small-stretch yarns are adopted as the second warps, and the shrinkage rate of the first warps is higher than that of the second warps.

5. The fabric woven by imitating warp knitting according to claim 1, wherein that stretch yarns are adopted as the first wefts and the second wefts.

6. The fabric woven by imitating warp knitting according to claim 1, wherein the proportion of the first warps and the second warps is 2:1 to 1:3, and the count of the first warps is coarser than the count of the second warps.

7. The fabric woven by imitating warp knitting according to claim 1, wherein the second warps and the second wefts adopt 8-shaft 3-progression sateen weave.

8. The fabric woven by imitating warp knitting according to claim 1, wherein the first warps and the first wefts adopt 3/1 right-hand twill weave.

9. The fabric woven by imitating warp knitting according to claim 1, wherein the first warps and the second warps are yarns made of staple fibers, yarns made of filaments, core-spun stretch yarns made by adopting staple fibers to cover elastic filaments or core-spun stretch yarns made by adopting filaments to cover elastic filaments;

if the first warps or the second warps are the yarns made of the staple fibers, the count range is between 6S and 60S;

if the first warps or the second warps are the yarns made of the filaments, the count range is between 40D and 600D;

if the first warps or the second warps are the core-spun stretch yarns made by adopting staple fibers to cover elastic filaments, the overall count range is between 6S and 60S, and the range of the elastic filaments is between 20D and 300D;

if the first warps or the second warps are the core-spun stretch yarns made by adopting staple fibers to cover elastic filaments, the overall count range is between 40D and 600D, and the range of the elastic filaments is between 20D and 300D; and the yarns adopted by the second warps may be the same as or different from the yarns adopted by the first warps.

10. The fabric woven by imitating warp knitting according to claim 1, wherein the first wefts and the second wefts are yarns made of staple fibers, yarns made of filaments, core-spun stretch yarns made by adopting staple fibers to cover elastic filaments or core-spun stretch yarns made by adopting filaments to cover elastic filaments;

if the first wefts or the second wefts are the yarns made of the staple fibers, the count range is between 6S and 60S;

if the first wefts or the second wefts are the yarns made of the filaments, the count range is between 40D and 600D;

if the first wefts or the second wefts are the core-spun stretch yarns made by adopting staple fibers to cover elastic filaments, the overall count range is between 6S and 60S, and the range of the elastic filaments is between 20D and 300D;

when the first wefts or the second wefts are the core-spun stretch yarns made by adopting filaments to cover elastic filaments, the overall count range is between 40D and 600D, and the range of the elastic filaments is between 20D and 300D; and the yarns adopted by the second wefts may be the same as or different from the yarns adopted by the first wefts.

* * * * *